US009693159B2

(12) United States Patent
Rung

(10) Patent No.: US 9,693,159 B2
(45) Date of Patent: Jun. 27, 2017

(54) METHOD OF FITTING A HEARING AID AND A HEARING AID

(71) Applicant: Widex A/S, Lynge (DK)

(72) Inventor: Martin Rung, Bronshoj (DK)

(73) Assignee: Widex A/S, Lynge (DK)

( * ) Notice: Subject to any disclaimer, the term of this patent is extended or adjusted under 35 U.S.C. 154(b) by 155 days.

(21) Appl. No.: 14/632,354

(22) Filed: Feb. 26, 2015

(65) Prior Publication Data

US 2015/0172839 A1 Jun. 18, 2015

Related U.S. Application Data

(63) Continuation-in-part of application No. PCT/EP2012/066981, filed on Aug. 31, 2012.

(51) Int. Cl.
*H04R 29/00* (2006.01)
*H04R 25/00* (2006.01)

(52) U.S. Cl.
CPC ..... *H04R 25/70* (2013.01); *H04R 25/30* (2013.01)

(58) Field of Classification Search
None
See application file for complete search history.

(56) References Cited

U.S. PATENT DOCUMENTS 3,882,848 A * 5/1975 Klar ..... A61B 5/121 181/135
4,586,194 A * 4/1986 Kohashi ..... H04R 29/001 381/60
2008/0228101 A1* 9/2008 Allen ..... A61B 5/411 600/559
2010/0177910 A1* 7/2010 Watanabe ..... H04R 5/04 381/94.1
2011/0038487 A1* 2/2011 Bai ..... H04R 1/1016 381/58

FOREIGN PATENT DOCUMENTS

EP 1594344 A2 11/2005
EP 2207366 A2 7/2010
WO 2010/115451 A1 10/2010

OTHER PUBLICATIONS

Rasetshwane, Daniel M., Stephen T. Neely, Jont B. Allen, and Christopher A. Shera. "Reflectance of acoustic horns and solution of the inverse problem." J. Acoust. Soc. Am. 131.3 (2012): 1863-73.*
Kolbrek, Bjorn. "Horn Theory: An introduction, part 1." audioxpress (2008).*
International Search Report for PCT/EP2012/066981 dated May 3, 2013.
Written Opinion of the International Searching Authority for PCT/EP2012/066981 dated Aug. 31, 2012.
(Continued)

*Primary Examiner* — Joseph Saunders, Jr.
*Assistant Examiner* — James Mooney
(74) *Attorney, Agent, or Firm* — Sughrue Mion, PLLC

(57) ABSTRACT

A method of fitting a hearing aid having means (104) for determining a real ear response. The invention also provides a hearing aid adapted for improved fitting.

14 Claims, 1 Drawing Sheet

(56) References Cited

OTHER PUBLICATIONS

S. Schmidt et al, "Measurement of Equal-Loudness Contours Using Eardrum Pressure as Reference Signal", 7th European Conference on Noise Control 2008, Euronoise 2008, Jan. 1 2008, pp. 3895-3900, XP055060955.

H. Hudde et al, "Methods for Estimating the Sound Pressure at the Eardrum", The Journal of the Acoustical Society of America, American Institute of Physics for the Acoustical Society of America, New York, NY, US, vol. 106, No. 4, Oct. 1, 1999, pp. 1977-1992, XP012001248.

* cited by examiner

METHOD OF FITTING A HEARING AID AND A HEARING AID

RELATED APPLICATIONS

The present application is a continuation-in-part of application PCT/EP2012066981, filed on 31 Aug. 2012, in Europe, and published as WO 2014032726 A1.

The present invention relates to a method of fitting a hearing aid. The present invention also relates to a hearing aid.

BACKGROUND OF THE INVENTION

1. Field of the Invention

In the context of the present disclosure, a hearing aid should be understood as a small, microelectronic device designed to be worn behind or in a human ear of a hearing-impaired user. A hearing aid system may be monaural and comprise only one hearing aid or be binaural and comprise two hearing aids. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a microelectronic circuit comprising a signal processor, and an acoustic output transducer (which may also be denoted a hearing aid receiver). The signal processor is preferably a digital signal processor. The hearing aid is enclosed in a casing suitable for fitting behind or in a human ear.

The mechanical design has developed into a number of general categories. As the name suggests, Behind-The-Ear (BTE) hearing aids are worn behind the ear. To be more precise, an electronics unit comprising a housing containing the major electronics parts thereof is worn behind the ear. An earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In some modern types of hearing aids a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids.

In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

In the present context the real ear response is to be interpreted as the determination of the sound pressure provided by a receiver in an earpiece, at a given excitation, to the eardrum of a user, when the earpiece is inserted in the ear canal of the user.

The excitation of the receiver is typically a driving voltage but may also be e.g. a driving current. The earpiece is typically a part of a hearing aid, but may also be e.g. part of an independent device for determination of the real ear response.

Individual variations in ear canal geometry, eardrum impedance and earpiece insertion causes significant variations in the response of a hearing aid receiver when mounted on real, individual ears. A variation across ears of 10 dB (or even more) is not uncommon.

In order to obtain a precise fitting of the hearing aid it is therefore necessary to measure and account for the real ear response on the individual real ear.

2. The Prior Art

It is well known within the art of hearing aids to measure the real ear response by inserting a thin probe microphone tube along with the earpiece to pick up the sound pressure as close as possible to the eardrum. Due to reflection of the sound waves by the eardrum the sound pressure at the eardrum and at other positions in the ear canal may differ. The probe microphone tube must therefore be inserted carefully and fixed to stay near the eardrum while also having the earpiece inserted in the ear canal. This is a time consuming procedure and not very comfortable for the hearing aid user. In some countries this task may only be performed by specifically qualified personnel.

Furthermore the tube may introduce a leakage between the earpiece and the ear canal wall causing an unrealistic venting and so bias the assessment of the real ear response, especially at low frequencies.

It has also been suggested within the art of hearing aids to determine the real ear response based on the sound pressure measured at other positions than right at the eardrum, typically by having a probe tube microphone extending from the earpiece into the residual volume so that the sound pressure is measured a distance, say 5 mm, from the surface of the earpiece. However, such a microphone will not be exposed to the same sound pressure as the eardrum, and the suggested methods all require complicated and careful calibration, high accuracy measurements and complex post processing, making them less suitable for routine clinical use.

For a measurement of the real ear response as part of the fitting procedure it would be convenient if the measurement would not involve handling and insertion of probe tubes and would not require extra steps to be carried out by the hearing aid fitter. For real ear response measurements to become a generally accepted part of the hearing aid fitting procedure this is very important.

It is therefore a feature of the present invention to provide a method of fitting a hearing aid system with improved precision.

It is another feature of the present invention to provide a method of fitting a hearing aid with improved precision and comprising the step of measuring the real ear response without requiring the hearing aid fitter to use probe tubes or to carry out additional measurements.

It is yet another feature of the present invention to provide a hearing aid adapted to provide a hearing aid fitting with improved precision.

SUMMARY OF THE INVENTION

The invention, in a first aspect, provides a method of fitting a hearing aid comprising the steps of providing an earpiece, said earpiece having an electrical-acoustical output transducer adapted for directing sound towards the eardrum when the earpiece is inserted in the ear canal of a user, and an acoustical-electrical input transducer adapted for measuring a sound pressure at the side of the earpiece facing the eardrum when the earpiece is inserted in the ear canal of the user; connecting the earpiece to a first end of a sound conduit of a predetermined length, providing a test sound into the sound conduit using the electrical-acoustical output transducer, and measuring a first sound pressure at the first end of the sound conduit using the acoustical-electrical input transducer; inserting the earpiece into the ear canal of the user, providing a test sound into the ear canal using the electrical-acoustical output transducer, and measuring a second sound pressure using the acoustical-electrical input transducer; determining a third sound pressure as an estimate of the first sound pressure that would have been measured if the sound conduit had been of infinite length; determining a scaling constant that when multiplied with the third sound pressure, provides an estimate of the third sound pressure that would have been measured if the sound conduit had a diameter corresponding to the diameter of the ear canal of the user; estimating the sound pressure at the eardrum of the user, for a given receiver excitation, as the sum of the second sound pressure and the third sound pressure multiplied with the scaling constant, hereby estimating the real ear response; and setting a hearing aid gain taking into account the estimated real ear response.

This provides a method with improved precision that does not require extra effort from the hearing aid fitter.

The invention, in a second aspect, provides a hearing aid having a hearing aid housing that comprises first and a second input transducer, a signal processor and an output transducer, wherein the first input transducer is adapted to measure the sound pressure in the ambient surroundings and the second input transducer is adapted to measure the sound pressure in the residual volume between the eardrum and the hearing aid housing when the hearing aid housing is inserted in an ear canal; the signal processor comprises real ear response measurement means adapted to perform a calibration measurement by activating the output transducer to provide a test sound, activating the second input transducer to measure the sound pressure of the test sound, and storing the result of said calibration measurement in a memory means; and the signal processor further comprises post processing means providing a closed form expression for the sound pressure at the eardrum of the ear canal when the hearing aid housing is inserted in the ear canal, wherein all variables in the closed form expression that relates to the individual user can be derived from the stored results of a first and a second calibration measurement providing a first and a second sound pressure as a function of frequency, and the length and volume of a sound conduit used in the second calibration measurement.

This provides a hearing aid that allows the hearing aid fitting to be carried out with improved precision without requiring extra effort from the hearing aid fitter.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

Figure 1:
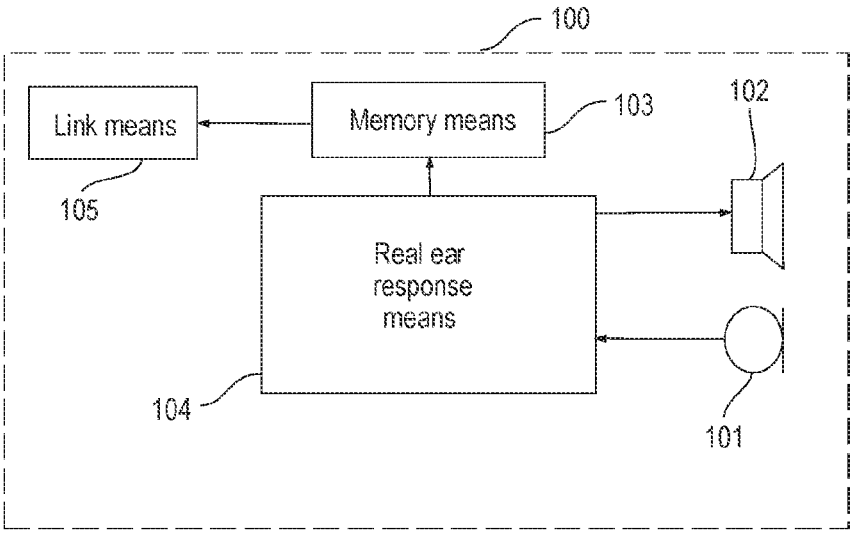
FIG. 1 illustrates highly schematically an earpiece according to an embodiment of the invention.

The inventor has found a method whereby a real ear response can be determined without the use of probe tubes, according to the various aspects of the invention.

The inventor has found a method whereby the precision of the determination of the real ear response is improved, according to the various aspects of the invention.

The inventor has also found a method whereby the hearing aid fitter can determine the real ear response without having to perform any time consuming and cumbersome additional measurements.

The idea behind this method exploits that an earpiece having an electrical-acoustical output transducer playing into an ear canal of a user—by a rough simplification—can be modeled by a high impedance source driving a short tube with a hard termination. This means that some properties of this simple system with very good approximation are shared by the earpiece when inserted in the ear.

Consider a short tube of diameter d and length L terminated by a hard wall. Two different impedance measures of this are essential for the idea:

$$\text{Input impedance: } Z_i = p_i/q_i \tag{1}$$

$$\text{Transfer impedance: } Z_t = p_e/q_i \tag{2}$$

where $p_i$ is the sound pressure at the input of the short tube, $p_e$ is the sound pressure at the end (the hard termination) of the short tube, and $q_i$ is the volume velocity at the input of the short tube.

Furthermore consider a tube of infinite length and diameter d. The input impedance of this is:

$$\text{Input impedance: } Z_0 = p_0/q_i \tag{3}$$

where $p_0$ is the sound pressure at the input of the tube of infinite length.

The relation between these three impedances is:

$$Z_t = (Z_i + Z_0)\cdot\exp(-j\cdot\omega\cdot\tau) \tag{4}$$

where $\omega$ is the angular frequency ($\omega = 2\cdot\pi\cdot f$) and $\tau$ is the propagation time from the input to the hard termination of the short tube. It is noticed that $Z_i$ and $Z_0$ are formed by quantities observed purely at the input of the tubes, while $Z_t$ includes the sound pressure at the termination. Thus the sound pressure at the termination can be determined from observations of the input.

Using the relations (1), (2) and (3) and assuming the volume velocity $q_i$ is kept constant the relation (4) transforms to:

$$p_e = (p_i + p_0)\cdot\exp(-j\cdot\omega\cdot\tau) \tag{5}$$

If only the magnitude of the sound pressure is of interest, relation (5) can be reduced to:

$$|p_e| = |p_i + p_0| \tag{6}$$

Because $Z_i$ of a closed tube is reactive and $Z_0$ is resistive, $p_i$ and $p_0$ are 90 degrees out of phase. This can be used in relation (6) to get:

$$|p_e|=(|p_i|^2+|p_0|^2)^{1/2} \tag{7}$$

From relation (7) it follows that the magnitude of $p_e$ can be determined without having to measure the phase of neither $p_i$ nor $p_0$.

The inventor has found that a typical hearing aid receiver driving a short sound bore in a hearing aid earpiece is very close to generating the same volume velocity when the earpiece is connected to respectively a closed tube and a tube that behaves approximately as an infinite tube. This means that the sound pressures in the relations (5), (6) and (7) represent valid approximations for the sound pressures generated by a hearing aid receiver, when assuming that the receiver is driven by a given excitation. Thus if a hearing aid receiver—instead of driving a short cylindrical tube with a hard termination—drives the residual volume of a human ear canal terminated by an eardrum, the relations in (5), (6) and (7) are still quite well achieved:

$$|p_e|\sim(|p_i|^2+|p_0|^2)^{1/2} \tag{8}$$

Now define $p_e'$ such that:

$$p_e'=(|p_i|^2+|p_0|^2)^{1/2} \tag{9}$$

Thus $p_e'$ can be used to estimate the magnitude of the sound pressure at the eardrum.

Hearing aids of the RITE and ITE type are well known examples of hearing aids that comprise an earpiece with a receiver that drives a short sound bore.

For relation (9) to be a good approximation for individual ear canals, $p_0$ should ideally be measured with an infinite tube of a diameter matching the "effective diameter" of the residual volume of the individual ear canal. Now, the "effective diameter" of the residual volume of the individual ear canal is at best very difficult and cumbersome to measure, and even if this number would be available, it still would require the availability of a multitude of infinite tubes with varying diameters to provide $p_0$.

However, the inventor has found that this requirement for the measurement of $p_0$ can be overcome in a simple manner by utilizing that:

- $p_0$ values found for infinite tubes of different diameters are similar except for a scaling factor, k, which is inversely proportional to the cross sectional area of the tube.
- the scaling factor, k, can be determined from $p_i$ and $p_0$ where $p_i$ is observed on an individual ear canal and $p_0$ is observed on a fixed reference diameter tube (having e.g. a diameter 8 mm) and will therefore in the following be denoted $p_{0ref}$. I.e. the scaling factor k can be determined from just the same quantities already used to estimate $p_e$.

So in the relations (5), (6), (7), (8) and (9) $p_0$ can be substituted by $k\cdot p_{0ref}$ and relation (9) becomes:

$$p_e'=(|p_i|^2+k^2\cdot|p_{0ref}|^2)^{1/2} \tag{10}$$

According to an advantageous embodiment k is determined by using that:

$$k=(d_{ref}/d_{eff})^2=S_{ref}/S_{eff}=S_{ref}/(V_{eff}/L_{eff}) \tag{11}$$

where $d_{ref}$ is the selected diameter of the "infinite" sound tube used to provide $p_{0ref}$, $S_{ref}$ is the cross sectional area of the "infinite" sound tube, $V_{eff}$ is the effective volume of the residual volume of the ear canal (i.e. the volume between the earpiece and the eardrum, when the earpiece is inserted in the ear canal), $d_{eff}$ is the effective diameter of the residual volume of the ear canal, $S_{eff}$ is the effective cross sectional area of the residual volume of the ear canal, and $L_{eff}$ is the effective length of the residual volume of the ear canal.

A typical human ear canal is irregular, and a generally accepted and strict definition of the "effective" dimensions, introduced above, does not exist. In the present context the "effective" dimensions are interpreted as the values of the dimensions that provide the best model of the real ear response when assuming that the residual volume of the ear canal is a cylinder.

The parameters characterizing the residual volume of the ear canal of a user are not readily at hand. However, the inventor has found that by measuring $p_i$ and $p_{0ref}$ for a range of frequencies spanning e.g. from 100 Hz to 10 kHz, some of the ear canal parameters can be determined:

- The effective length, $L_{eff}$, of the residual volume can be derived from the notch frequency $f_{notch}$ of the curve representing $p_i$ divided by $p_{0ref}$ as a function of frequency:

$$L_{eff}=c/(4\cdot f_{notch}) \tag{12}$$

where c is the speed of sound in air. A variety of data analysis techniques exist in order to extract a frequency notch from a curve, all of which are obvious for a person skilled in the art.

- The effective volume, $V_{eff}$, of the residual volume can be derived from $p_i$ divided by $p_{0ref}$ at a frequency of 2 kHz (because the compliance of the eardrum mainly affects $p_i$ divided by $p_{0ref}$ below 1 kHz and the frequency notch mainly affects $p_i$ divided by $p_{0ref}$ above 3 kHz):

$$V_{eff}=V_{ref}/(p_i/p_{0ref}) \tag{13}$$

where $V_{ref}$ is the effective volume of the "infinite" sound tube, which is determined by multiplying the length $L_{ref}$ and the cross-sectional area $S_{ref}$. In variations $V_{eff}$ of the residual volume can be derived from $p_i$ divided by $p_{0ref}$ at any frequency within the interval of 1-3 kHz.

Consequently k can be estimated by combining relations (11), (12) and (13) since $V_{ref}$, $L_{ref}$ and $S_{ref}$ are readily available, once the "infinite" sound tube used to measure $p_{0ref}$ has been selected:

$$k=(d_{ref}/d_{eff})^2=S_{ref}(c/(4\cdot f_{notch}))/(V_{ref}/(p_i(\text{at 2 kHz})/p_{0ref}(\text{at 2 kHz}))) \tag{14}$$

Further the inventor has found that an even better estimate for k can be found by:

$$k=(d_{ref}/d_{eff})^2=S_{ref}(c/(4\cdot f_{notch}))^{1.4}/(V_{ref}/(p_i(\text{at 2 kHz})/p_{0ref}(\text{at 2 kHz}))) \tag{15}$$

The reason for this is that a lower notch frequency has a larger impact on the measurements carried out at 2 kHz. Since a lower notch frequency tends to decrease the magnitude of the measurements at 2 kHz, this effect may be somewhat compensated by increasing the exponent as given in relation (15). However, depending on e.g. the type of earpiece or the frequency for $p_i$ and $p_{0ref}$ used in (15), the value of the exponent may be selected from a range of say 1 to 2.

However, several approaches to determine k for an individual ear canal exist. According to an embodiment k is determined using transmission line modeling of the acoustical system comprising the "infinite" sound conduit and numerical optimization. The parameters $L_{eff}$ and $d_{eff}$ of the transmission line model are varied until the response of the transmission line model corresponds best to the measured response of the earpiece when inserted in the ear canal. Hereby the desired value of the effective diameter $d_{eff}$ is found and can subsequently be inserted in (11) to find k.

It is noted that the methods used to find k generally depend on the criteria selected in order to determine when a best match is found.

The following describes highly schematically the method steps to be carried out in order to fit a hearing aid system according to an embodiment of the invention.

Initially a hearing aid earpiece is provided that comprises an electrical-acoustical output transducer adapted for directing sound towards the eardrum when the earpiece is inserted in the ear canal of the user, and an acoustical-electrical input transducer adapted for measuring a sound pressure at the side of the earpiece facing the eardrum when the earpiece is mounted in the ear canal of the user. According to an embodiment the transducers are adapted to direct sound to, or measure a sound pressure at, a given side of the hearing aid earpiece via a short sound bore connecting the transducers with the outer surface of the hearing aid earpiece. The inventor has found that at least the sound bores in RITE and ITE hearing aids are typically so small that they can be neglected when considering the formulas used to derive the closed form expression for the sound pressure at the eardrum.

Next the earpiece is connected to a first end of a sound conduit, a test sound is provided into the sound conduit by the electrical-acoustical output transducer and a first sound pressure $p_{0ref}$ at the first end of the sound conduit is measured using the acoustical-electrical input transducer.

The length of the sound conduit is such that the first sound pressure $p_{0ref}$ can be used to estimate the sound pressure at the input of a sound conduit of infinite length. According to an embodiment the length of the sound conduit is 20 meter and the second end of the conduit is open. The sound conduit hereby provides a good approximation of a sound conduit of infinite length. In variations the second end of the conduit need not be closed when the sound conduit is sufficiently long—e.g. 20 meter or more.

Basically what is required for a sound conduit to approximate a sound conduit of infinite length is that the acoustical impedance of the second end of the sound conduit approximates the characteristic impedance of the sound conduit.

An estimate of the sound pressure at the input of a sound conduit of infinite length based on a measurement of the sound pressure at the input of a sound conduit of absolute length can be achieved using a variety of methods, all of which will be obvious for a person skilled in the art. Some of these alternative methods include the use of sound conduits with highly damping material, such as e.g. foam, tufted fabric or fiber, at the second end, or the use of relatively short sound conduits in combination with subsequent data analysis in order to remove the impact from the short sound conduit—i.e. the reflections from the second end.

According to still other variations the estimate of the sound pressure at the input of a sound conduit of infinite length can be derived from a measurement of the sound pressure at the input of a sound conduit of a first absolute length and a measurement of the sound pressure at the input of a sound conduit of a second absolute length. The derivation requires the use of data analysis methods that will be obvious to a person skilled in the art.

The diameter of the sound conduit is selected to be similar to the effective diameter of a typical human ear canal. According to an embodiment the diameter is 8 mm. In variations of the embodiment the diameter may be in the range between 2 and 15 mm. The requirements for the sound conduit diameter are very relaxed because the measurements can be interpolated in a simple manner as has already been discussed above.

According to an embodiment the sound conduit has the form of a tube, but this need not be so, as other forms may provide reasonable approximations to the tube. The selection of other forms will be obvious for a person skilled in the art.

According to an advantageous embodiment, the first sound pressure $p_{0ref}$ is measured by the hearing aid manufacturer as part of the hearing aid manufacturing, and the first sound pressure is stored in the hearing aid together with the dimensional characteristics of the "infinite" sound tube that are required as input to the closed form expression used to determine the real ear response. Hereby the work load of the hearing aid fitter is relieved and the hearing aid user can be fitted in shorter time.

Then the earpiece is inserted into the ear canal of the user and the acoustical-electrical input transducer is used to measure a second sound pressure $p_i$ in response to a test sound provided by the electrical-acoustical output transducer.

According to an embodiment the test sound is a pure tone with a specific frequency. This allows the sound pressure at the eardrum to be estimated as a function of frequency by repeated measurements with different frequencies. However, the test sound needs not be a pure tone, a variety of other test sounds are suitable for allowing a frequency dependent response to be determined, all of which will be obvious for a person skilled in the art. As an example even white noise can be used as test sound and a frequency dependent response can be provided by frequency analyzing the signal measured by the acoustical-electrical input transducer.

According to an especially advantageous embodiment the second sound pressure is measured using a test sound that is available anyway as it is used for another purpose in the hearing aid, whereby no additional time or effort is required for the hearing aid fitter since the real ear response can be determined automatically. An example of such a test sound is the test sound used for assisting in initialization of the feedback system. According to the advantageous embodiment the feedback test sound is, at the same time, measured by the ambient hearing aid microphone and the ear canal microphone. The measurement by the ambient microphone is used as input to the feedback system and the measurement by the ear canal microphone (the second sound pressure) is used as input to the closed form expression for determining the real ear response. The feedback test sound is further advantageous in that a suitable frequency dependent response can be derived from it.

Subsequently an estimate of the real ear response is determined by inserting the measured first and second sound pressures $p_i$ and $p_{0ref}$ into the closed form expression together with the cross-section $S_{ref}$ and the length $L_{ref}$ of the sound tube used to measure $p_{0ref}$.

Finally the hearing aid is fitted taking the real ear response into account. The real ear response can be incorporated in the hearing aid fitting in a variety of ways all of which will be obvious for a person skilled in the art of hearing aid fitting. Basically the real ear response simply adds a correction gain value to the prescribed gain value.

In particular it is well known within the art of hearing aids that hearing aid receivers are typically operated in the linear domain, and a real ear response determined for only one value of the receiver driving voltage is therefore sufficient to improve the precision of a hearing aid fitting, at least for a frequency determined by the frequency content of the test sound used to determine the real ear response.

According to various aspects of the invention, the closed form expression may be stored in the hearing aid or in a hearing aid fitting system.

In the former case the individual hearing aid receiver response is calculated in the hearing aid and either transferred to the hearing aid fitting system, or the hearing aid is adapted such that the hearing aid automatically adjusts the frequency dependent gains that have been provided by the hearing aid fitting system, in accordance with the individual hearing aid receiver response.

In the latter case, the hearing aid transfers the first and second sound pressure values and the dimensional characteristics of the "infinite" sound conduit to the hearing aid fitting system which calculates the real ear response based on the closed form expression, and incorporates the result in the subsequent hearing aid fitting.

According to various aspects of the invention the ear piece needs not be a hearing aid earpiece. Thus the earpiece of the invention may be a custom made device that does not include any hearing aid functionality.

Reference is now made to FIG. 1 which shows highly schematically an earpiece 100 according to an embodiment of the invention. The hearing aid earpiece comprises an ear canal microphone 101, a receiver 102, a memory 103, real ear response means 104 and link means 105.

The real ear response means 104 are adapted to initiate and control a procedure where a test sound is provided by the receiver 102, a sound pressure is measured by the ear canal microphone 101 in response to the provided test sound, and the resulting second sound pressure is stored in the memory 103.

The memory 103 is adapted to store the value of the first sound pressure measured with the "infinite" sound tube, the value of the length of the "infinite" sound tube, the value of the cross-sectional area of the "infinite" sound tube and the second sound pressure.

The link means 105 is adapted to transmit the values stored in the memory 103 to a hearing aid fitting system (not shown), whereby a real ear response for the earpiece 100 inserted in the ear canal of a user can be determined.

Figure 2:
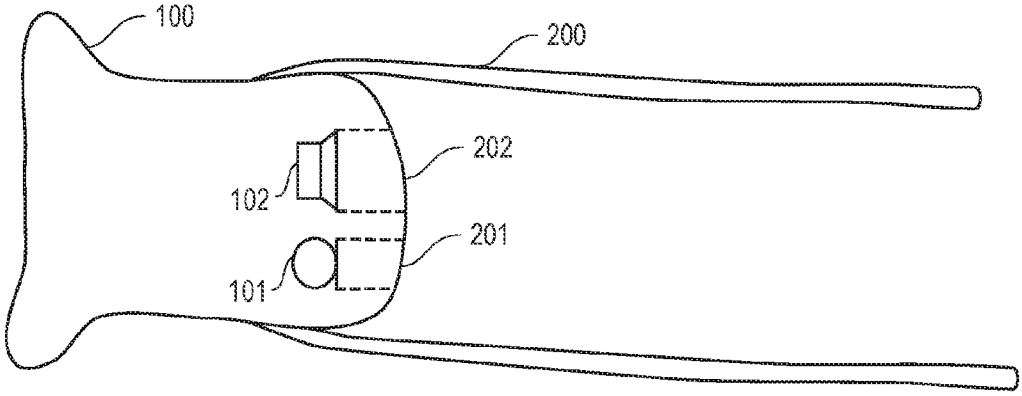
FIG. 2 illustrates highly schematically an earpiece connected to a sound conduit according to an embodiment of the invention.

Reference is now made to FIG. 2 which shows highly schematically an earpiece 100 connected to a sound conduit 200 according to an embodiment of the invention. The earpiece 100 comprises an ear canal microphone 101 and a receiver 102 that are acoustically connected, through a first sound bore 201 and a second sound bore 202 to the surface of the side of the earpiece adapted to face towards the eardrum of the user when inserted in the ear canal of the user.

The inventor has found that it is advantageous to measure the sound pressure at the surface of the earpiece, since this provides for a more robust measurement.

It is well known within the art of hearing aids to include an ear canal microphone in a hearing aid earpiece, see e.g. WO-A1-2010/115451.

I claim:

1. A method of fitting a hearing aid comprising the steps of:

providing an earpiece, said earpiece having an electrical-acoustical output transducer adapted for directing sound towards the eardrum when the earpiece is inserted in the ear canal of a user, and an acoustical-electrical input transducer adapted for measuring a sound pressure at the side of the earpiece facing the eardrum when the earpiece is inserted in the ear canal of the user;

connecting the earpiece to a first end of a sound conduit of a predetermined length, providing a test sound into the sound conduit using the electrical-acoustical output transducer, and measuring a first sound pressure at the first end of the sound conduit using the acoustical-electrical input transducer;

inserting the earpiece into the ear canal of the user, providing a test sound into the ear canal using the electrical-acoustical output transducer, and measuring a second sound pressure using the acoustical-electrical input transducer;

determining a third sound pressure as an estimate of the first sound pressure that would have been measured if the sound conduit had been of infinite length;

determining a scaling constant that when multiplied with the third sound pressure, provides an estimate of the third sound pressure that would have been measured if the sound conduit had a diameter corresponding to the diameter of the ear canal of the user;

estimating the sound pressure at the eardrum of the user, for a given receiver excitation, as the sum of the second sound pressure and the third sound pressure multiplied with the scaling constant, hereby estimating the real ear response; and setting a hearing aid gain taking into account the estimated real ear response.

2. The method according to claim 1, wherein the first, second and third sound pressures are determined for a range of frequencies.

3. The method according to claim 2 wherein said range of frequencies is comprised in a range extending from 50 Hz and up to 20 kHz.

4. The method according to claim 1, wherein the acoustical-electrical input transducer is adapted for measuring a sound pressure at the surface of the earpiece.

5. The method according to claim 4, wherein the acoustical-electrical input transducer is acoustically connected to the surface of the earpiece by a sound bore.

6. The method according to claim 1, wherein the step of determining a third sound pressure is carried out by adapting the sound conduit such that it behaves approximately as a sound conduit of infinite length and setting the third sound pressure equal to the first sound pressure.

7. The method according to claim 6, wherein the sound conduit is longer than 5 meter.

8. The method according to claim 6, wherein acoustical damping material is inserted in the second end of the sound conduit.

9. The method according to claim 1, wherein the step of determining the scaling constant comprises:

providing the ratio of the second sound pressure over the third sound pressure as a function of frequency, hereby providing a curve;

using the curve to estimate the diameter of the residual volume between the earpiece and the ear drum, when the hearing aid is inserted in the users ear canal; and calculating the scaling constant as the square of the ratio of the diameter of the sound conduit over the estimate of the diameter of the residual volume.

10. The method according to claim 9, wherein a notch frequency is determined from the curve and used to determine an effective length of the residual volume.

11. The method according to claim 9, wherein the value of the curve at a frequency in the range between 1 and 3 kHz is used to determine the effective volume of the residual volume.

12. A hearing aid having a hearing aid housing that comprises first and a second input transducer, a signal processor and an output transducer, wherein the first input transducer is adapted to measure a sound pressure in the ambient surroundings and the second input transducer is adapted to measure a sound pressure in the residual volume between the eardrum and the hearing aid housing when the hearing aid housing is inserted in an ear canal;

the signal processor is configured to perform a calibration measurement by activating the output transducer to provide a test sound, activating the second input transducer to measure a sound pressure of the test sound, and storing the result of said calibration measurement in a memory;

the signal processor is further configured to provide a closed form expression for a sound pressure at the eardrum of the ear canal when the hearing aid housing is inserted in the ear canal, wherein all variables in the closed form expression that relates to the individual user can be derived from the stored results of a first and a second calibration measurement providing a first and a second sound pressure as a function of frequency, and the length and volume of a sound conduit used in the second calibration measurement;

the first sound pressure is provided when the hearing aid housing is inserted in the ear canal;

the second sound pressure is provided when the hearing aid housing is connected to a first end of a sound conduit such that a test sound can be provided into the sound conduit and a sound pressure at the first end of the sound conduit can be measured; and the sound pressure measured at the first end is used to estimate a sound pressure at the input of a sound conduit of infinite length.

13. The hearing aid according to claim 12, wherein the hearing aid is a RITE hearing aid.

14. The hearing aid according to claim 12, wherein the hearing aid is an ITE hearing aid.

* * * * *